US005261328A

United States Patent [19]

de la Haye

[11] Patent Number: 5,261,328

[45] Date of Patent: Nov. 16, 1993

[54] BROAD-AREA DEFENSE MINE WITH EXPANDED EFFECTIVE ZONE

[75] Inventor: Johannes de la Haye, Kürten, Fed. Rep. of Germany

[73] Assignee: Dynamit Nobel Aktiengesellschaft, Troisdorf, Fed. Rep. of Germany

[21] Appl. No.: 715,368

[22] Filed: Jun. 14, 1991

[30] Foreign Application Priority Data

Jun. 15, 1990 [DE] Fed. Rep. of Germany ..... 4019148

[51] Int. Cl.[5] ..... F42B 23/16; F42B 23/24

[52] U.S. Cl. ..... 102/425; 102/401

[58] Field of Search ..... 102/427, 401, 387, 425, 102/424

[56] References Cited

U.S. PATENT DOCUMENTS

| | | | |
|---|---|---|---|
| 4,476,784 | 10/1984 | Reynes | 102/424 |
| 4,711,178 | 12/1987 | Argyrakis | 102/387 |
| 4,848,236 | 7/1989 | Hembise | 102/427 |
| 4,870,904 | 10/1989 | Picot | 102/387 |
| 4,922,824 | 5/1990 | Schubart | 102/425 |
| 4,979,444 | 12/1990 | Schoffl | 102/401 |

FOREIGN PATENT DOCUMENTS

| | | | |
|---|---|---|---|
| 3720672 | 1/1989 | Fed. Rep. of Germany . | |
| 3536328 | 5/1990 | Fed. Rep. of Germany . | |
| 3543769 | 5/1990 | Fed. Rep. of Germany . | |
| 3934979 | 4/1991 | Fed. Rep. of Germany . | |
| 9012997 | 11/1990 | World Int. Prop. O. | 102/427 |

*Primary Examiner*—David H. Brown

*Attorney, Agent, or Firm*—Antonelli, Terry, Stout & Kraus

[57] ABSTRACT

In a broad-area defense mine, the inclination under which an active member can rise or can be fired from an ambush position can be varied with the aid of at least one adjusting member between the positioning frame and a mounting or support for the active member which, in turn, are connected by way of a universal joint. In this arrangement, the mine, in the same way and with equal reliability as heretofore, combats a target within a specific area, but it is possible by means of this device to defend a substantially larger zone: the mine is transported, within the larger zone, to the "correct" site.

13 Claims, 3 Drawing Sheets

BROAD-AREA DEFENSE MINE WITH EXPANDED EFFECTIVE ZONE

BACKGROUND OF THE INVENTION

This invention relates to a mine with an active member supported in an active member mounting and with a positioning frame, wherein the active member, coupled with a drive mechanism, can leave the active member mounting in an upward direction or toward the side, and the active member mounting and the positioning frame are connected by way of a universal joint.

A positioning device for an air-deployable mine has been known from DE 3,817,265 AL and from corresponding U.S. Pat. No. 4,922,824. By means of a universal suspension between the mine housing and the supporting legs, which legs can be spread apart, the objective is achieved that the mine is oriented vertically in the field of gravity even in uneven terrain, and that the mine, when starting from the ambush position, is transported perpendicularly to the horizontal, i.e. vertically upwardly. The zone that can be combated by such a mine from above is in all cases a circle, with the active member mounting being the center.

German Patent Application P 39 34 979.9 published on Apr. 25, 1991, discloses a mine wherein an active member, fixedly oriented (in most case horizontally) in its inclination by means of a universal joint, can also be additionally rotated about a vertical axis. The active member, always being launched under the same inclination, does fly in the direction of the target to be combated, but frequently misses the target with respect to elevation.

SUMMARY OF THE INVENTION

It is an object of this invention to increase the efficiency of a known broad-area defense mine by expanding the area controllable by a mine without any substantial modifications of the concept of the broad-area defense mine.

The object has been attained by a mine of the type heretofore described, which is characterized in that at least one adjusting member is provided between an active member mounting and a positioning frame, making it possible to change the inclination of the active member mounting and thus also the launching direction of the active member determined by the mine axis, but wherein the adjusting member initially does not affect the setting of the equilibrium position of the active member in the gravitational field during the placing or righting of the mine.

With this relatively simple and reliable feature, the "basic circle" within which an upwardly rising active member can independently seek and combat the target is not altered, but this circle is movable. With an active member that leaves the positioning frame or cradle laterally, the circular, initially linear target area around the positioning frame can be broadened into a belt. The enlargement of the searching zone is not obtained at the cost of incurring other disadvantages. The area controllable by the mine has become substantially larger due to the measure taken in accordance with this invention. The active member of the mine travels, within this larger area, into the "correct" zone for which it is optimally designed. By transporting the active member of the mine to higher levels, an enlargement of the deployment zone could also be attained, it is true; however, this would also require a more powerful drive or propulsion mechanism and would lead to an undesirable increase in the time between launching of the mine and detonation of the charge. Owing to the inclination of the active member mounting relatively to the vertical, in the direction of the target to be combated, an upwardly launched active member approaches this target faster and more closely and can accomplish its assigned task with a higher degree of probability. With an inclination of the mine axis by, for example, ±15° in two mutually perpendicular directions and/or with the combination of the two inclinations, the area to be combated can be more than tripled without having to transport the active member of the mine to a higher level, and without restriction of target accuracy. The effective charge of the active member executes a gyratory motion during descent and is suspended from a parachute in such a way that it is pointed toward the earth at a specific angle with respect to the perpendicular and, in addition, revolves.

The adjusting member according to this invention can be of various structures. In the simplest case, the adjusting member merely brings about a one-time, predetermined directional change. In a more sophisticated design, two linearly independent adjusting members are mounted so that thereby a specific inclination of the active member mounting and thus also of the mine axis can be set for any desired direction.

The adjusting member, in a preferred embodiment, is also to exert a damping effect and/or can be connected together with a damping member. Such an adjusting member is shown in U.S. Pat. No. 4,152,025. A pendulating or rocking of the mine, for example due to w gusts, is to be restricted by damping. However, the damping active must not impede the initially desired perpendicular alignment of the mine during righting or placing. With such a damping device, a comparison member can be omitted with a controlled adjustment of a specific mine inclination since the perpendicular is always given by the mine which is suspended in a freely pendulating fashion, as long as the pendulating motions ar negligible.

In another preferred embodiment, a servomechanism (motor) is additionally provided between the positioning frame and the active member mounting whereby an active member which does not start in the vertical direction can be oriented into an adjustable direction at an incline to the vertical.

Additional advantageous embodiments are described in the detailed description of the invention.

BRIEF DESCRIPTION OF THE DRAWINGS

The invention is illustrated in the accompanying drawings and is further described hereinafter with reference to these drawings by way of example. In the drawings.

DETAILED DESCRIPTION OF THE INVENTION

Figure 1:
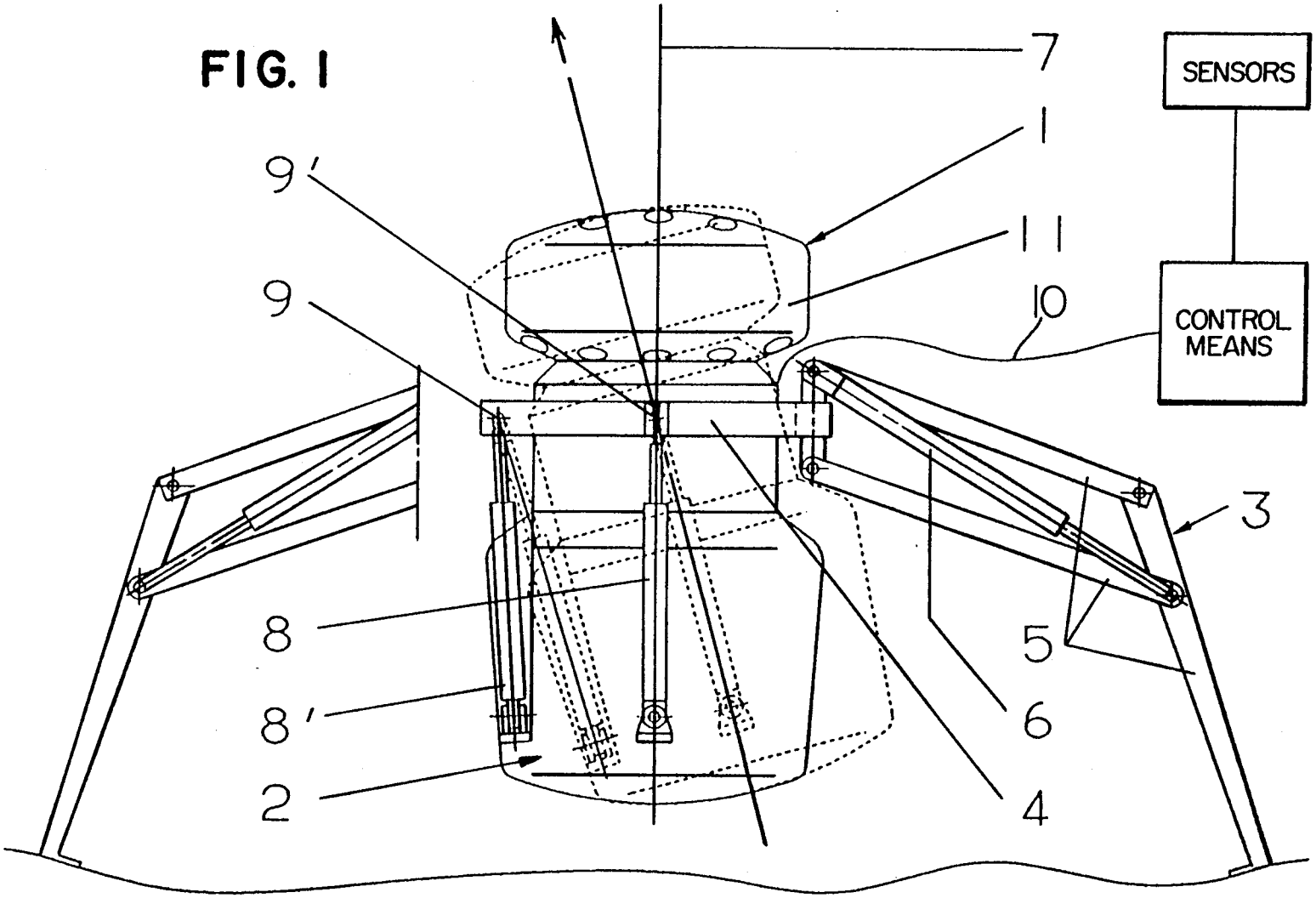
FIG. 1 shows a broad-area defense mine in an ambush with an upwardly starting active member.

FIG. 1 shows a simplified view of a righted broad-area defense mine with an upwardly starting active member in an ambush position; the dot-dash lines characterize the position of active member and active member mounting after an adjusting member has been activated. The mine comprises three basic parts, an active member 1, an active member mounting 2, and a positioning frame or cradle 3, wherein the active member mounting 2 and the positioning frame 3 are joined by way of a universal joint 4. During distribution of the broad-area defense mine from the air (e.g., from an airplane via a parachute) the righting elements 5 of the positioning frame 3 are clapped against the mine body. With the aid of drive elements 6 for the righting elements 5, the mine body 1 is lifted after landing so that it is suspended in a freely pendulating fashion in the universal joint 4 and the longitudinal axis 7 of the active member is initially oriented practically perpendicularly (i.e. vertically) even in case of uneven terrain. Between the locking outer rim of the universal joint 4, to which also the positioning frame 3 is attached, and the active member mounting 2, two adjusting members 8, 8' are fastened, offset at an angle of 90°. Upon operation of the adjusting members 8, 8', the active member mounting 2 tilts about the axes 9, 9' of the universal joint 4. In this example, the adjusting members 8, 8' are pistons movable by pyrotechnical charges; these pistons can move once from the central position upwards or downwards, and then remain fixed in this final position. Thus, the mine axis can be inclined about the positioning frame by 15° into one of eight directions respectively different from each other by 45°.

An electronic control circuit of the mine produces the command as to which adjusting member is to be moved in the vertical direction. By means of conventional sensors (not shown) self-laid by the mine, which feed signals into an electronic circuit of the control circuit or control means of the mine by way of sensor wires 10, a determination can be made with regard to the direction where the target to be combated is to be sought. Only after adjustment has taken place will be rocket engine 11 be started up; the active member 1 is transported more closely to the target to be combated, i.e. the target will be for a longer time within the searching circle of the mine than in case of starting the mine, as done heretofore, perpendicularly to the horizontal, i.e. in an upward vertical direction.

Figure 2:
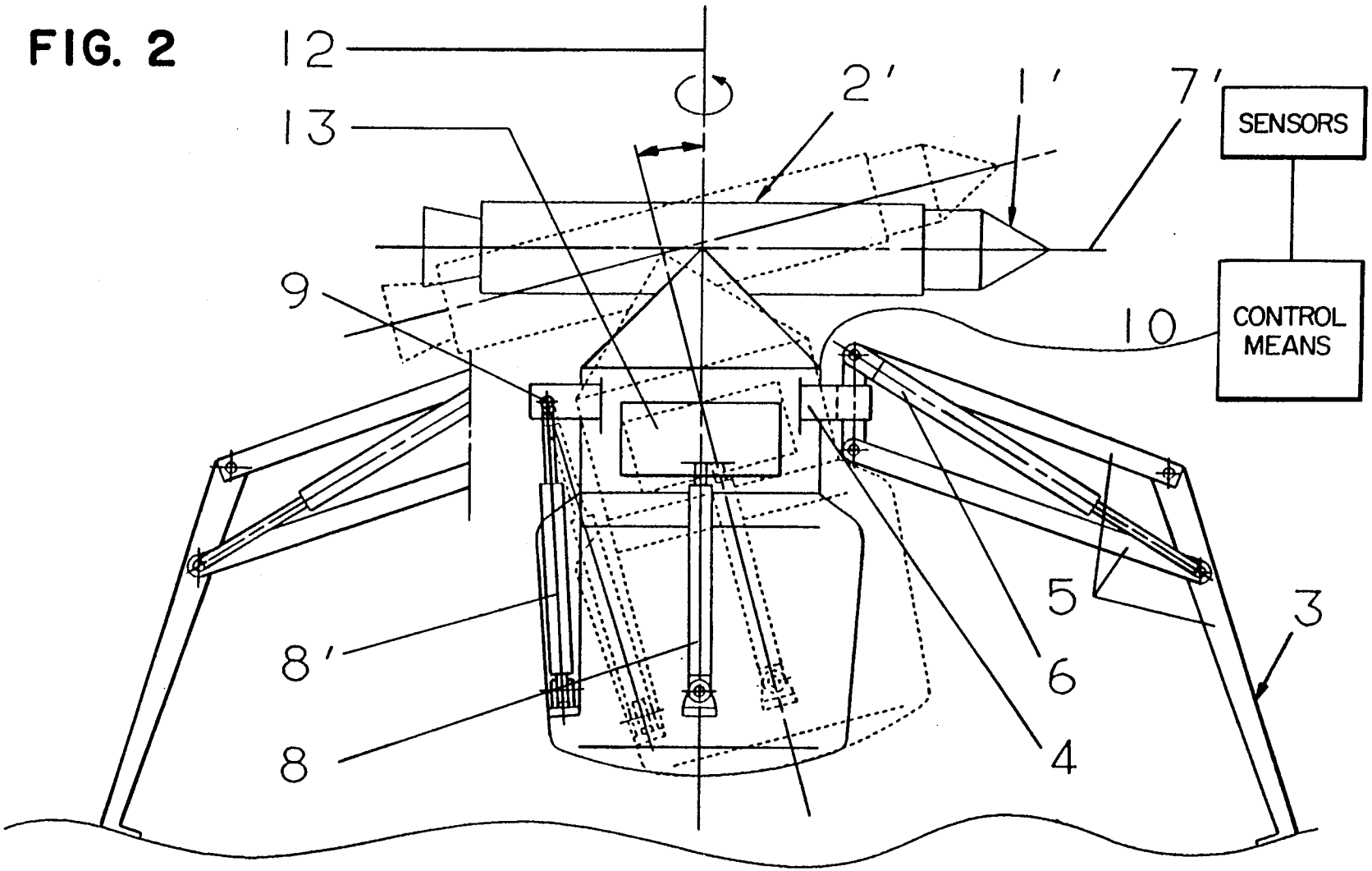
FIG. 2 shows a broad-area defense mine in the ambush position with a horizontally starting active member and with a drive mechanism for azimuthal alignment.

With an active member 1' exiting from the positioning frame 3 in the lateral direction, as in FIG. 2, the target area can be expanded according to this invention toward two directions. By means of the adjusting members 8, 8', the inclination of the active member mounting 2' (as well as the active member axis 7') during firing can be varied toward the top or toward the bottom of the mine. The mass distribution is rotationally symmetrical to the longitudinal axis 12 of the mounting 2' and, as a consequence of the universal joint 4, the active member mounting 2' (with a sufficiently low center of gravity) is initially horizontal. Moreover, in this version, the active member mounting 2' is also rotatable about the axis 12. The azimuthal alignment of the active member 1' takes place by means of a drive or servomechanism 13 in conjunction with a compass or directional sensors (not shown). Instead of a circularly linear target zone, as in an embodiment according to German Patent Application P 39 34 979.9, a circular area expanded in the manner of a belt is achieved in accordance with this invention.

It will be understood that the active member 1' of this embodiment differs from the active member 1 of the first embodiment in that active member 1' has a sensor means in the nose portion for directing the active member 1' (in this case a missile type member) to the target. However, the active member 1 of the first embodiment is equipped with a parachute and is a projectile chargedirecting type mine as shown, for example, in U.S. Pat. No. 4,979,444. The active member 1 executes a gyratory motion during its descent and is equipped with a sensor which detects the target on the ground and causes at least one projectile to fire downwardly towards the target.

Figure 3:
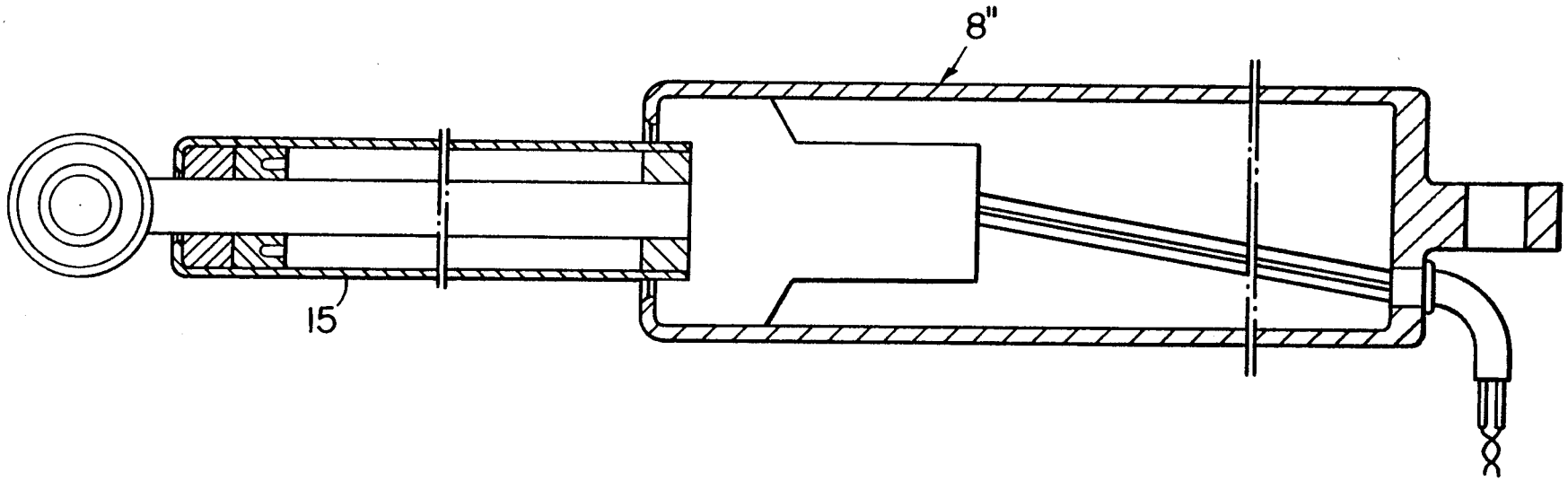
FIG. 3 shows a schematic view of an adjusting member provided with a damping element or member.

FIG. 3 shows a schematic illustration of adjusting member 8' which has a piston movable by a pyrotechnical charge and which is provided with a damping member 15 to exhibit a damping action.

What is claimed is:

1. A broad-area defense mine comprising an active member supported in an active member mounting and a positioning frame, the active member being coupled with a drive mechanism for transporting the active member more closely to a target and the active member being arranged at one end of the active member mounting to leave the active member mounting in an upward direction or horizontally toward the side upon activation of the drive mechanism, the active member mounting and the positioning frame being connected by a universal joint, and means including at least one adjusting member provided between the active member mounting and the universal joint for varying the inclination of the active member mounting and also a starting direction of the active member; said positioning frame including a drive element for righting of the mine and for setting the mine in an equilibrium position and the at least one adjusting member having no influence on the initial setting of the equilibrium position of the active member in the field of gravity during righting of the mine.

2. A mine according to claim 1, wherein said at least one adjusting member includes means for effecting a continuous adjustment of the inclination of the active member mounting.

3. A mine according to claim 1, wherein said at least one adjusting member includes means for effecting a stepwise adjustment of the inclination of the active member mounting.

4. A mine according to claim 1, wherein said at least one adjusting member includes means for effecting only a one-step change of the inclination of the axis of the mine.

5. A mine according to claim 1, wherein the at least one adjusting member comprises a work cylinder which can be acted upon in two directions.

6. A mine according to claim 1, wherein the active member is arranged to leave the active member mounting horizontally to the side and a servo mechanism is also arranged between the positioning frame and the active member mounting to effect an azimuthal alignment of the active member.

7. A mine according to claim 1, wherein the drive mechanism comprises a rocket engine.

8. A mine according to claim 1, wherein the active member is arranged coaxially with a longitudinal axis of the active member mounting so that the active member will leave the active member mounting in an upward direction.

9. A mine according to claim 1, further comprising control means for actuating the at least one adjusting member, said control means responsive to sensors for determining the direction where the target to be combated is to be sought.

10. A mine according to claim 1, wherein the at least one adjusting member comprises two adjusting members mounted between the active member mounting and the universal join attached to the positioning frame.

11. A mine according to claim 10, wherein the two adjusting members are attached to the universal joint at different locations so that the inclination of the active member mounting effected by one adjusting member is linearly independent of a movement of the other adjusting member.

12. A mine according to claim 1, wherein the at least one adjusting member comprises at least one damping element provided between the active member mounting and the universal joint.

13. A mine according to claim 5, wherein the at least one adjusting member further comprises means for damping the movement of the active member mounting relatively to the universal joint.

* * * * *